US006719032B1

(12) United States Patent
Miers

(10) Patent No.: US 6,719,032 B1
(45) Date of Patent: Apr. 13, 2004

(54) SHUTTER WITH ARTICULATED ELEMENTS EQUIPPED WITH AN ELECTRICAL DRIVING DEVICE

(76) Inventor: Edward Miers, Langestraat, 28, Asse (BE), B-1730

( * ) Notice: Subject to any disclaimer, the term of this patent is extended or adjusted under 35 U.S.C. 154(b) by 58 days.

(21) Appl. No.: 09/856,473

(22) PCT Filed: Oct. 5, 2000

(86) PCT No.: PCT/BE00/00115

§ 371 (c)(1),
(2), (4) Date: Jun. 8, 2001

(87) PCT Pub. No.: WO01/27426

PCT Pub. Date: Apr. 19, 2001

(30) Foreign Application Priority Data

Oct. 8, 1999 (EP) ..... 99870206

(51) Int. Cl.[7] ..... E05F 15/16
(52) U.S. Cl. ..... 160/188; 160/201; 160/209
(58) Field of Search ..... 160/201, 188, 160/209; 49/358, 362, 325

(56) References Cited

U.S. PATENT DOCUMENTS

| | | | | |
|---|---|---|---|---|
| 1,981,026 | A | * | 11/1934 | Blodjett |
| 2,015,402 | A | * | 9/1935 | Johanson |
| 2,589,480 | A | * | 3/1952 | Curtis |
| 2,703,236 | A | * | 3/1955 | Verdier |
| 2,747,863 | A | * | 5/1956 | Huppert et al. |
| 2,755,081 | A | | 7/1956 | Johnson et al. |
| 2,790,635 | A | * | 4/1957 | Evans et al. |
| 2,922,638 | A | | 1/1960 | Smith |
| 3,204,170 | A | | 8/1965 | Monks |
| 3,252,503 | A | | 5/1966 | Jackson |
| 3,289,350 | A | | 12/1966 | Moody |
| 3,311,159 | A | * | 3/1967 | Stansberry |
| 3,336,968 | A | | 8/1967 | Curtis |
| 3,797,171 | A | * | 3/1974 | Farmer |
| 3,934,635 | A | * | 1/1976 | Kin |
| 4,167,833 | A | * | 9/1979 | Farina et al. |
| 4,732,203 | A | * | 3/1988 | Alten |
| 4,750,294 | A | * | 6/1988 | Lafontaine |
| 5,036,899 | A | * | 8/1991 | Mullet |
| 5,429,170 | A | * | 7/1995 | Nogaki |
| 5,664,372 | A | * | 9/1997 | Williams et al. ..... 49/362 |
| 5,738,161 | A | * | 4/1998 | Martin |
| 5,799,368 | A | * | 9/1998 | Young ..... 16/92 |
| 6,041,845 | A | * | 3/2000 | Couch ..... 160/201 |
| 6,094,779 | A | * | 8/2000 | Young ..... 16/92 |
| 6,326,751 | B1 | * | 12/2001 | Mullet et al. ..... 318/434 |

FOREIGN PATENT DOCUMENTS

| | | |
|---|---|---|
| EP | 0 222 204 A1 | 5/1987 |
| EP | 0 523 630 A1 | 1/1993 |
| WO | WO 01/27426 A2 | 4/2001 |

* cited by examiner

*Primary Examiner*—Blair M. Johnson
(74) *Attorney, Agent, or Firm*—Jacobson Holman PLLC

(57) ABSTRACT

Shutter (4) with articulated elements (6) guided by two rails (8) having a first rectilinear part (8V) mounted in the plane that the shutter (4) is to occupy in the closed position, connected by a curved part (8C) to a second rectilinear part (8H), mounted in the plane that the shutter (4) is to occupy in the open position. This shutter (4) is equipped with an electrical drive device having:

two drive tracks (10) mounted respectively along said second rectilinear part (8H) of the rails (8), a carriage (5) having a frame carried and guided by the second rectilinear part (8H) of the rails (8), there being mounted on this frame a drive shaft (24), an electric motor (22) and a transmission between the shaft (24) and the motor (22), pinions (27) or notched wheels fixed to the two ends of the shaft (24) meshing with the drive tracks (10), connection mechanisms (30, 31) between the carriage (5) and the closest shutter element (6), and a control station for controlling the running and stopping of the motor.

21 Claims, 10 Drawing Sheets

XVIII
XIX
XVII
105
51
24R
24
12
13
15
22
30
32
33
54
55
56
57
110
111
114
116
117
118
119
120
121
123
125
126
127
128
129
134
158

SHUTTER WITH ARTICULATED ELEMENTS EQUIPPED WITH AN ELECTRICAL DRIVING DEVICE

The present invention concerns a device for electrically driving a shutter with articulated elements.

Such shutters are well known and consist of a series of rectangular panels, the largest dimension of which extends horizontally, these panels being connected to one another, by their horizontal edges, by means of articulations. The lateral edges of these panels are provided with running rollers or similar mechanisms which run in guide rails, by means of which the shutter is guided from its open position to its closed position and vice versa. These rails each have a first rectilinear part (in general, vertical in substance) mounted in a fixed manner along one side of the door opening, the upper part of this first rectilinear part being connected, by means of a curved part, to a second rectilinear part (and generally horizontal in substance) mounted in a fixed manner in the plane which the shutter is to occupy in its open position.

Such shutters are normally used as garage doors or warehouse doors, but also as road vehicle doors and in particular as rear doors of trucks or vans.

These shutters can optionally be activated manually, which can often be done without too much difficulty, at least when the shutters are not too large and, in particular, too tall.

This is because, as a general rule, such shutters are provided with a balancing spring device that pulls the shutter towards its open position and thus counterbalances, at least approximately or partially, the weight of the shutter that pulls it towards its closed position.

In many cases, it is however desirable that such a shutter is equipped with an electrical drive device. Many types of device have already been designed and proposed to that end.

U.S. Pat. No. 2,560,236 describes an electrical drive device for a door shutter, in which the mechanical transmission between the electric motor and the upper element of the shutter comprises a chain (of the Galle chain or roller chain type) guided in a rail.

U.S. Pat. No. 2,922,638 describes a device for electrically driving a garage door. This device comprises an electric motor and a drive shaft both carried by arms fixed in an articulated manner to the upper element of the shutter. A belt and pulley transmission is provided between the motor shaft and the drive shaft. The latter carries a pinion at each of its two ends. These two pinions mesh with racks mounted along the horizontal part of the shutter guide rails.

EP-0 291 171 describes a door shutter for trucks equipped with a drive device with an electric motor. This device comprises a system of winches and belts, at least one of these belts having one end fixed to an element at the bottom of the shutter and at least one other belt having one end fixed to an element at the top of the shutter.

The door shutter described in NL 8902808 has a number of points of similarity with that described in EP-0 291 171, but the belts (which are preferably notched belts) are fixed by one of their ends to an element at the bottom of the shutter and by their other end to an element at the top of the shutter.

EP-0 222 204 describes a shutter with articulated elements, equipped with one or more electric motors activating a pinion which meshes with a rack mounted parallel to the rails of the shutter. The motor or motors is (are) fixed against one of the elements of the shutter, on the side turned towards the inside of the room or space closed by this shutter. When the shutter is in the open position, the motor (or each motor) is therefore suspended under the shutter element to which it is fixed.

A proposal has been made to drive truck shutters by a hydraulic system that comprises one or two hydraulic jacks situated close to the ceiling of the load space of the truck and the end of the piston rod of which is connected, in an articulated manner, to the upper element of the shutter.

Such a hydraulic system involves the use of very long jacks, which furthermore limits its application possibilities to sufficiently long trucks. This is because, when the shutter is closed, the total length of the jack (cylinder+piston rod) is necessarily a little greater than twice the height of the shutter.

To remedy this drawback, the device described in NL 9000459 comprises a double acting pneumatic cylinder, with free-floating piston (without a piston rod). The movement of this free-floating piston is transmitted to a sliding sleeve disposed around the pneumatic cylinder, by virtue of the fact that this piston and this sleeve are both provided with magnetic elements. The sliding sleeve is connected to one element (lower or upper) of the shutter. It will be understood that the magnetic (and not mechanical) connection between the piston and the sleeve can be a source of problems and also limit the application of such a system to relatively small and light shutters.

Certain of the shutter electrical drive devices which have been proposed up to now have been considered fairly satisfactory and notably fairly reliable, as long as they were used for equipping garage doors, warehouse doors or other building shutters.

Generally speaking, these shutter electrical drive devices have not given satisfaction when they have been used for equipping doors of trucks or similar vehicles; on account of their sometimes faulty operation and too many failures, they are considered to be insufficiently reliable. This observation also applies to the electrical drive devices that are nevertheless presented as being especially designed to equip vehicle shutters.

The fact that one and the same shutter electrical drive device can give satisfaction when it is used for equipping a garage shutter and, on the other hand, suffers too many failures when used for equipping a truck shutter, is due to a number of causes. The main one of these causes of difficulties and breakdowns is due to the fact that, when the truck starts, runs and stops, the electrical drive device of the shutter and the mechanisms composing it are subject to incessant vibrations and jolts which have particularly harmful effects when the truck runs on bumpy roads.

With vehicle shutter electrical drive devices proposed up to now, it may also be noted that these vibrations and jolts can cause at least partial opening of the vehicle shutter during running. Keeping such a shutter in the closed position by means of a lock, latch or similar fastening device is considered to be an unacceptable solution, notably because of the waste of time this involves.

Generally speaking, the truck shutter electrical drive devices proposed up to now are also too bulky. For this reason, they reduce the load capacity of the trucks to an unacceptable extent.

There is, however, a real demand for shutter electrical drive devices operating in a truly satisfactory and reliable manner for equipping doors of trucks or similar vehicles therewith.

It will be understood that such a device must not only be reliable, so as to be able to be used for a long time without notable risk of failure, but it must also be compact, so as to reduce the load capacity of the truck as little as possible.

The aim of the present invention is to provide such a device.

The electrical drive device according to the invention has been designed and perfected for equipping shutters of trucks or similar vehicles therewith, but this device can obviously also advantageously be used for equipping garage shutters, warehouse shutters or other building shutters therewith.

One object of the present invention is a shutter with articulated elements, the movement of which between a closed position and an open position, and vice versa, is guided by two rails disposed along the path that is to be followed by guide rollers with which the lateral edges of the elements of the shutter are provided. These guide rails each have a first rectilinear part mounted in the plane that the shutter is to occupy, in substance, in its closed position, this first part being connected by means of a curved part to a second rectilinear part mounted in the plane that the shutter is to occupy, in substance, in its open position. The shutter according to the invention is equipped with an electrical drive device that has two drive tracks respectively mounted parallel along said second rectilinear part of the guide rails, and that also has:

1) a carriage disposed between the second rectilinear parts of the two guide rails, this carriage having:
   - a rigid frame carried and guided by said second rectilinear part of said guide rails for a translational movement parallel to this part of the two rails,
   - a drive shaft mounted able to rotate on said frame, a pinion or a notched wheel being fixed to each of the two ends of this shaft, these two pinions or notched wheels meshing respectively with the two drive tracks,
   - an electric motor, provided with a motor shaft, mounted on the frame and connected to an electrical supply,
   - a transmission between the motor and the drive shaft, the motor shaft and the drive shaft being situated higher than the level of said second rectilinear part of the guide rails,
2) connection mechanisms between the carriage and the shutter element closest thereto,
3) a control station capable of controlling the running and stopping of the motor and therefore of controlling the opening and closing of the shutter,
   said carriage being capable of moving between extreme positions which correspond to the positions of complete closure and complete opening of the shutter, said connection mechanisms being provided with elastic elements which, when the carriage is in its extreme position which corresponds to the position of complete closure of the shutter, exert a pressure on the shutter element closest to the carriage.

It is important to note that the "drive tracks" are elongated elements with which the pinions or notched wheels fixed to the ends of the drive shaft can mesh. The drive shafts can notably be racks (in which case rack pinions are fixed to the ends of the drive shaft) or notched belts (in which case notched wheels are fixed to the ends of the drive shaft). The drive tracks can optionally also be chains such as Galle chains or roller chains (in which case pinions or wheels for appropriate chains are fixed to the ends of the drive shaft).

As indicated above, the guide rails have "a first rectilinear part mounted in the plane that the shutter is to occupy, in substance, in its closed position". It is important to understand by this that this first rectilinear part of the rails is mounted in the plane that at least the major part of the shutter is to occupy when it is in its closed position. This is because, with the majority of shutters with articulated elements, the upper articulated element is in an oblique position with respect to the plane in which the rest of the shutter is disposed when said shutter is in its closed position, the guide rollers situated close to the upper edge of this upper articulated element being engaged in the curved part of the guide rails.

The same remark applies with regard to the plane in which the second part of the two guide rails is mounted, since the articulated element constituted by the bottom of the shutter when said shutter is in the closed position can possibly be in an oblique position with respect to the plane in which the rest of the shutter is disposed when said shutter is in its open position.

The guide rails preferably have a section that is U-shaped in substance, the opening of the U of each rail being directed towards the other rail. It is this type of rail that is usually used for guiding shutters with articulated elements. A U-shaped rail more specifically preferred will be described below in a description of one embodiment of the invention, referring to the accompanying drawings.

When use is made of these rails having a section which is U-shaped in substance, the frame is advantageously guided by running rollers with which the opposite sides of the frame are provided, these running rollers being engaged in the second rectilinear part of the two guide rails.

The frame is advantageously guided in the second rectilinear part of each of the two U-sectioned guide rails, by at least three running rollers. Two of these rollers are disposed so as to be able to run against a part of the rail that corresponds in substance to one of the branches of the U of its section, and the third of these rollers is disposed so as to be able to run against a part of the inside of the rail that corresponds in substance to the other branch of the U of its section.

The electrical supply of the electric motor mounted on the frame is achieved preferably by means of a system of sliding contacts comprising electrical contact rails fixed in place parallel to the drive tracks, and contact brushes carried by the carriage.

The electric motor is advantageously provided with a motor brake. It is also advantageous that this motor is provided with a disengaging mechanism capable of being activated manually.

According to one particular embodiment, the transmission between the motor and the drive shaft is a chain transmission, the motor shaft and the drive shaft each being equipped with a sprocket wheel.

According to another embodiment, the transmission between the motor and the drive shaft is a notched belt transmission, the motor shaft and the drive shaft each being equipped with a notched wheel. This kind of transmission notably offers the advantage of operation that has little noise.

Of course, other types of transmission can also be suitable, like for example a gear transmission.

It is advantageous that the connection mechanisms between the carriage and the shutter element closest thereto connect the carriage to at least two parts of this shutter element which are laterally spaced apart from one another, with respect to the direction of translational movement of this shutter element.

Even for fairly wide shutters, it is generally sufficient that these connection mechanisms connect the carriage to only two parts of the shutter element closest to the carriage. These two parts of this shutter element must preferably be situated symmetrically with respect to the middle of the width of the shutter and advantageously fairly close to the lateral edges thereof.

According to a preferred embodiment, the connection mechanisms between the carriage and the shutter element closest thereto comprise a gas piston buffer. When the shutter is brought into its position of closure, this gas piston buffer is compressed and thus holds the shutter firmly in its closed position. This gas piston buffer can optionally be replaced by another means fulfilling the same function, like for example a metal spring device.

The electrical drive device of the shutter must be provided with means that limit the possible movement of the carriage between extreme positions that correspond respectively to the complete opening and the complete closure of the shutter.

These means can notably consist of two end-of-travel switches that stop the motor when the carriage has reached one or other of these extreme positions.

These switches are fixed in place on the path of the carriage, adjustable activation mechanisms, capable of activating one or other of the two end-of-travel switches, being mounted on the carriage.

During opening of the shutter, one of the end-of-travel switches stops the motor (and therefore also the carriage and the shutter) when the shutter has reached its position of complete opening.

During closure of the shutter, another end-of-travel switch stops the motor when the carriage has gone past, by a small predetermined distance (a few centimeters, for example), its position which corresponds to complete closure of the shutter. When, during closure of the shutter, the latter has reached its position of complete closure, it is stopped in this position on account of its lower edge coming up against the door opening threshold, the floor of the truck or any stop whatsoever. At this time, the carriage still continues its movement over a small distance (a few centimeters) before being stopped as a result of activation of the end-of-travel switch. For this reason, the gas piston buffers, with which the connection mechanisms between the carriage and the shutter are provided, are compressed, so as to hold the shutter firmly in its closed position.

The means capable of limiting the translational movement of the carriage can also consist of a photoelectric cell-based electronic device or a proximity detector-based electronic device.

According to a preferred embodiment, the electrical drive device control station is a remote electrical control station. This type of control station is known per se and usually comprises a small housing containing the necessary electronic elements and provided with buttons which must be activated to control the opening or closing of the shutter. It is in any case clearly preferable that this control station is a secure station of the "dead-man" type, with which the movement of the shutter towards its position of opening or its position of closure can continue only as long as the corresponding control button is activated.

According to a first embodiment of the electrical drive device with which the shutter is equipped, said drive tracks consist of racks. In this case, a rack pinion is fixed to each of the two ends of the drive shaft, these two pinions meshing respectively with the two racks.

According to an advantageous embodiment, the second rectilinear part of each of the two guide rails extends, in the direction opposite to the curved part of this rail, beyond the end of the rack mounted along this rail. It must be understood that, by virtue of this particular arrangement, the rigid frame (and therefore the carriage) would remain guided and supported by the guide rails in the case where, moving in the direction which corresponds to the opening of the shutter, it goes past the position beyond which the pinions of the drive shaft have gone past the end of the racks and are therefore no longer meshed therewith. The advantages provided by this particular arrangement are explained in the remainder of this description.

According to a preferred embodiment, the two racks are respectively mounted above the second rectilinear part of the two guide rails. In this case, the teeth of the two racks are preferably situated at the opposite side to the guide rails above which they are mounted, that is to say, the racks are disposed with their toothed part situated upward.

It is generally advantageous that the two racks are respectively immovably attached to the guide rails above which they are mounted.

According to a second embodiment of the electrical drive device with which the shutter is equipped, said drive tracks consist of notched belts. In this case, a notched wheel is fixed to each of the two ends of the drive shaft, these two notched wheels meshing respectively with the two notched belts.

Each of the two notched belts is fixed parallel along the second rectilinear part of a guide rail. Each of the two ends of each notched belt is fixed to a fixing support. At least one of these supports is provided with means for exerting and maintaining an appropriate tension on the notched belt.

The two notched belts are preferably respectively mounted above the second rectilinear part of the two guide rails.

According to an advantageous embodiment, the notched side of the notched belts is turned downward.

Two free deflecting wheels keep each notched belt, constituting a drive track, meshed with the corresponding notched wheel. These two deflecting wheels preferably keep each notched belt meshed with at least one third of the circumference of the corresponding notched wheel.

Another object of the invention is a device for electrically driving a shutter with articulated elements, the movement of which between a closed position and an open position, and vice versa, is guided by two rails disposed along the path that is to be followed by guide rollers with which the lateral edges of the shutter elements are provided. These guide rails each have a first rectilinear part mounted in the plane that the shutter is to occupy, in substance, in its closed position, this first part being connected by means of a curved part to a second rectilinear part mounted in the plane that the shutter is to occupy, in substance, in its open position. This device has two drive tracks capable of being respectively mounted parallel along said second rectilinear part of the two guide rails, and also has:

1) a carriage capable of being disposed between the second rectilinear parts of the two guide rails, this carriage having:
   - a rigid frame capable of being carried and guided by said second rectilinear part of said guide rails for a translational movement parallel to this part of the two rails,
   - a drive shaft mounted able to rotate on said frame, a pinion or a notched wheel being fixed to each of the two ends of this shaft, these two pinions or notched wheels meshing respectively with the two drive tracks,
   - an electric motor, provided with a motor shaft, mounted on the frame and connected to an electrical supply,
   - a transmission between the motor shaft and the drive shaft,
2) connection mechanisms, provided with elastic elements, capable of connecting the carriage to the shutter element closest thereto,
3) a control station capable of controlling the running and stopping of the motor and therefore of controlling the opening and closing of the shutter.

The disposition of the various elements constituting the device is such that, when said frame is carried and guided by said second rectilinear part of said guide rails, the motor shaft and the drive shaft are situated higher than this second part of the guide rails, and that said two pinions or notched wheels mesh respectively with the two drive tracks.

Another object of the invention is a road transport vehicle that has a shutter according to the invention. Usually, this shutter gives access to a space for loading goods.

Provision is made for an opening to be made in the bodywork of the vehicle according to the invention (generally in the roof of the body of the truck or van) close to the place where the disengaging mechanism for the motor of the electrical drive device for the shutter is situated, when this shutter is in the position of closure. This opening can be closed by a closure device such as, for example, a small flap mounted on hinges. Said opening makes it possible to have access, from outside the vehicle, to this disengaging mechanism and to activate it manually.

If an electrical fault (for example a fault in the vehicle battery) occurs while the shutter is closed, this particular arrangement makes it possible to manually activate said disengaging device and then manually open the shutter.

It is clearly advantageous that the closure of said closure device is made secure by a lock or a similar means.

Other features and advantages of the invention will emerge from the description, given below by way of non-limitative examples, of two embodiments of the invention, reference being made to the accompanying drawings, in which.

Figure 1:
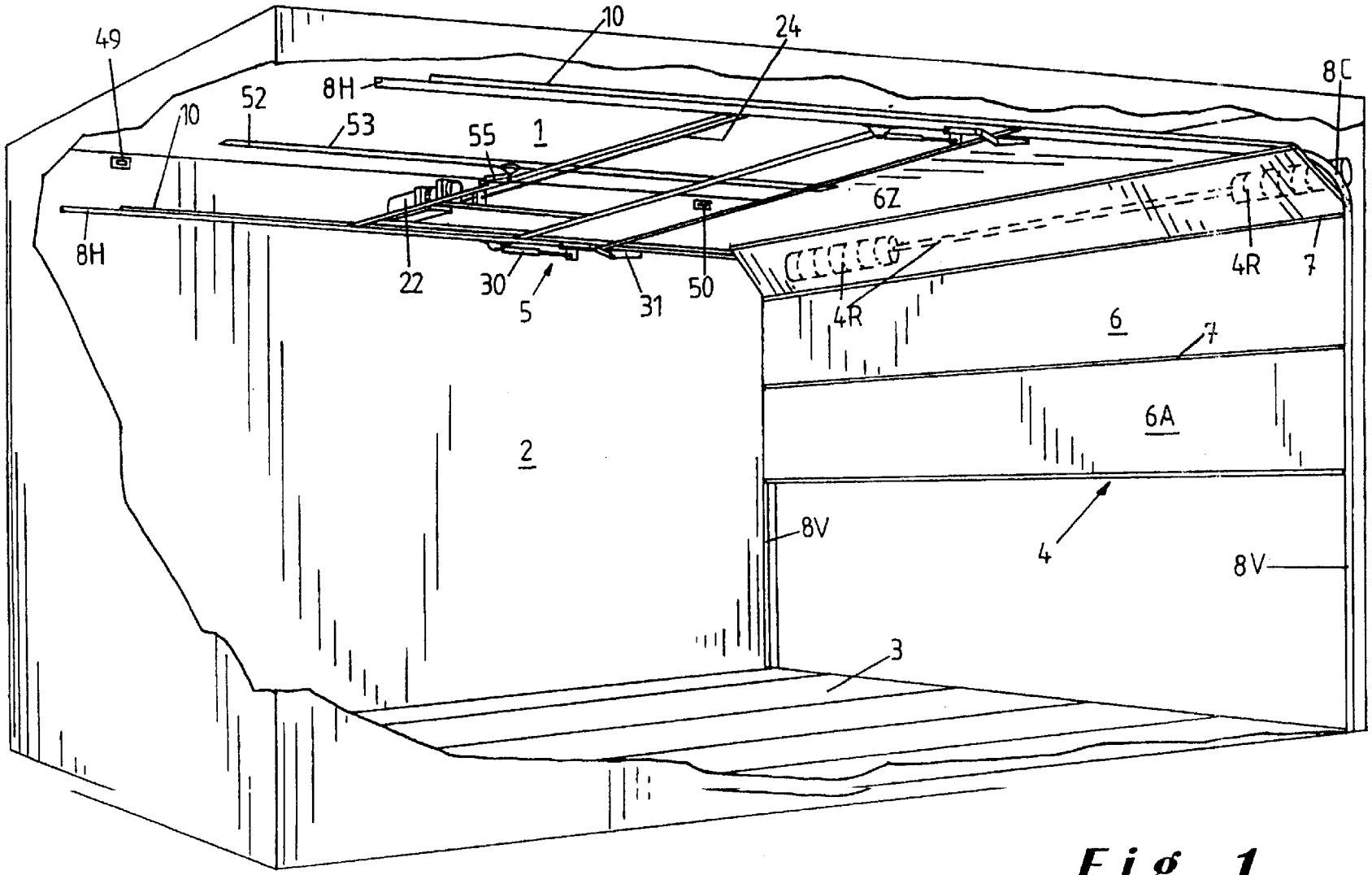
FIGS. 1 to 12 illustrate the first of these embodiments.
Figure 2:
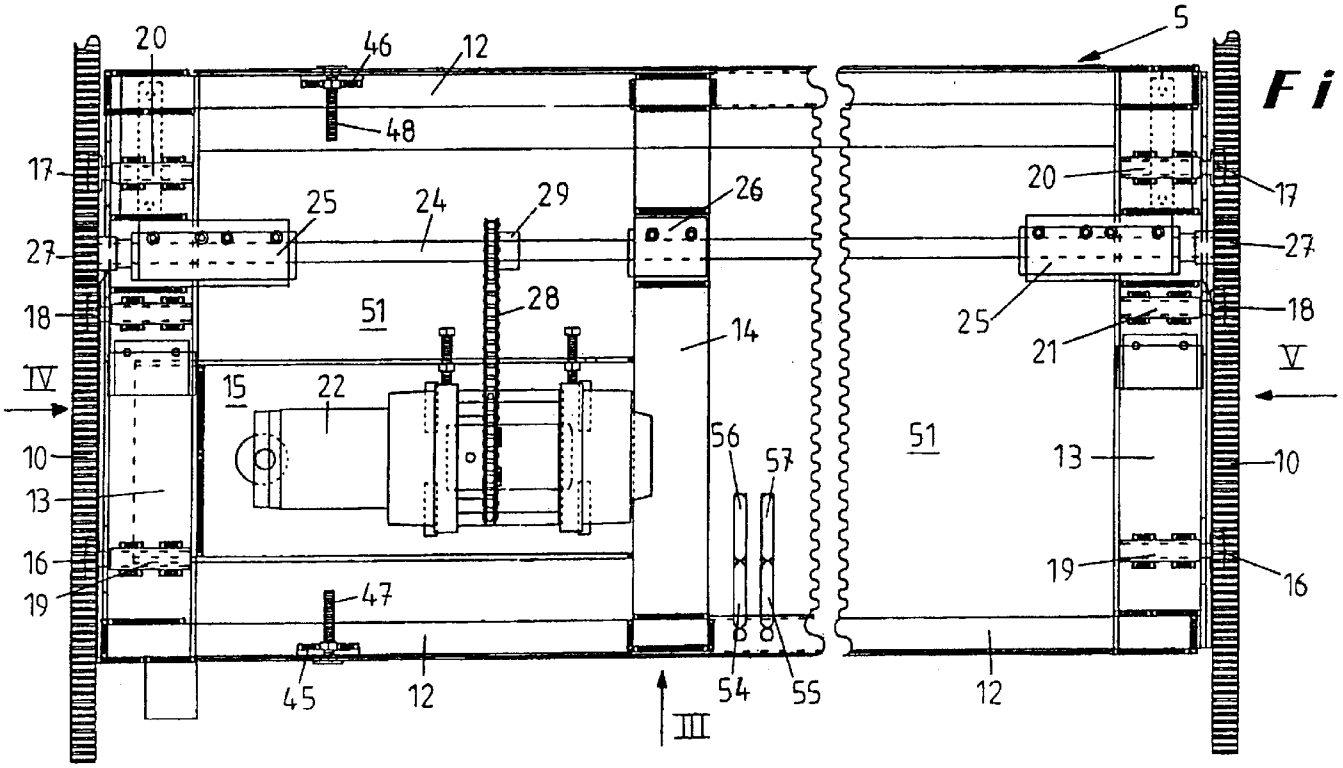
Figure 3:
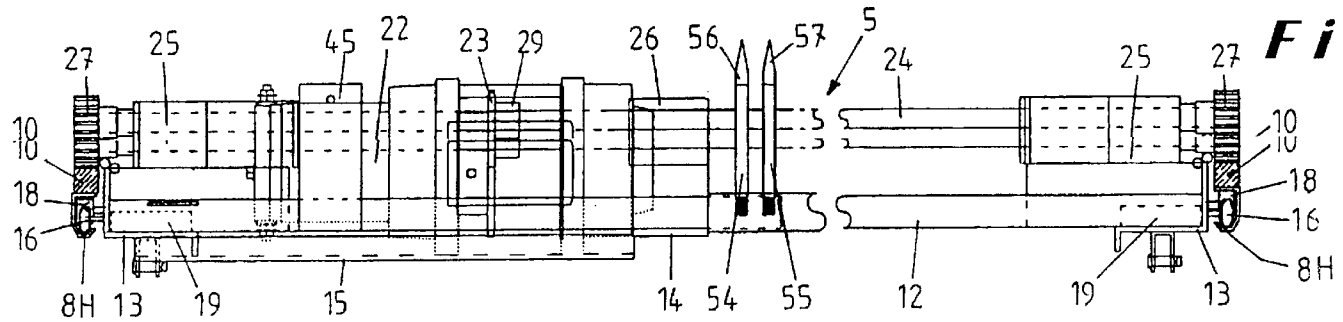
Figure 4:
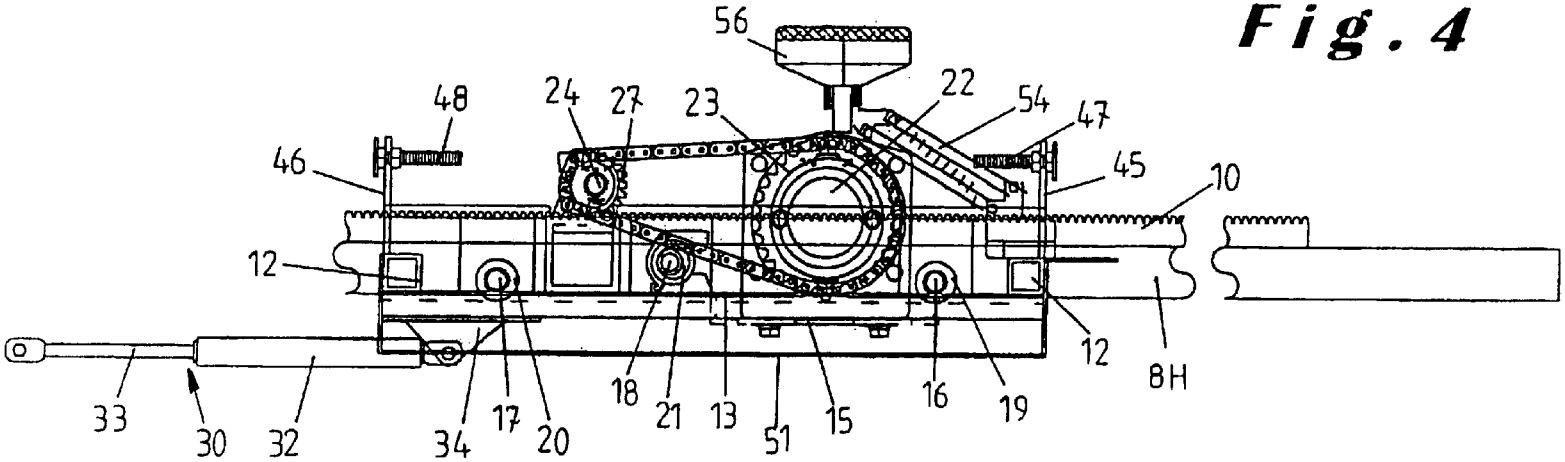
Figure 5:
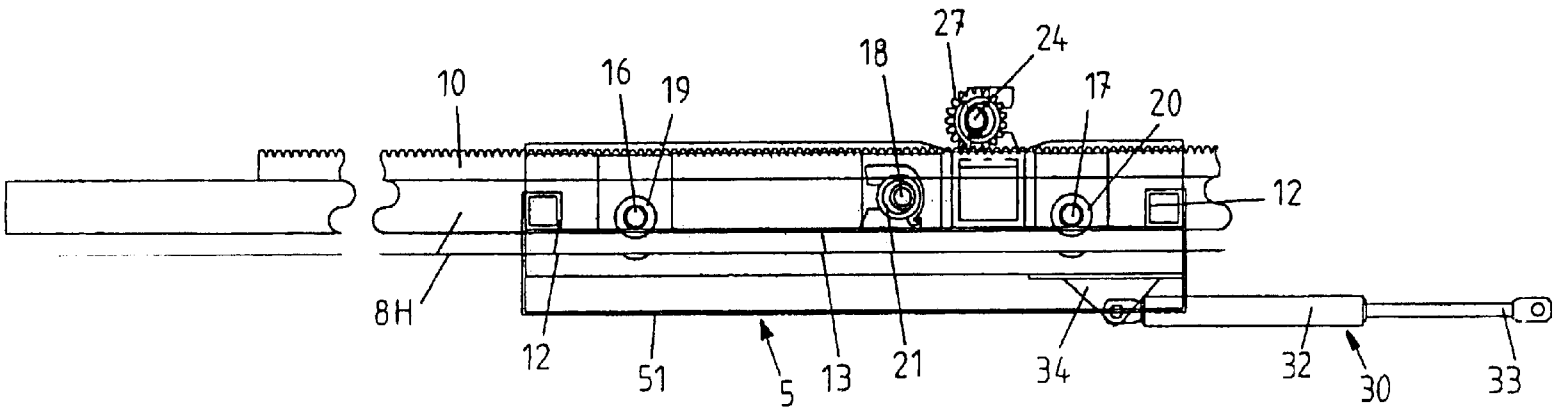
Figure 6:
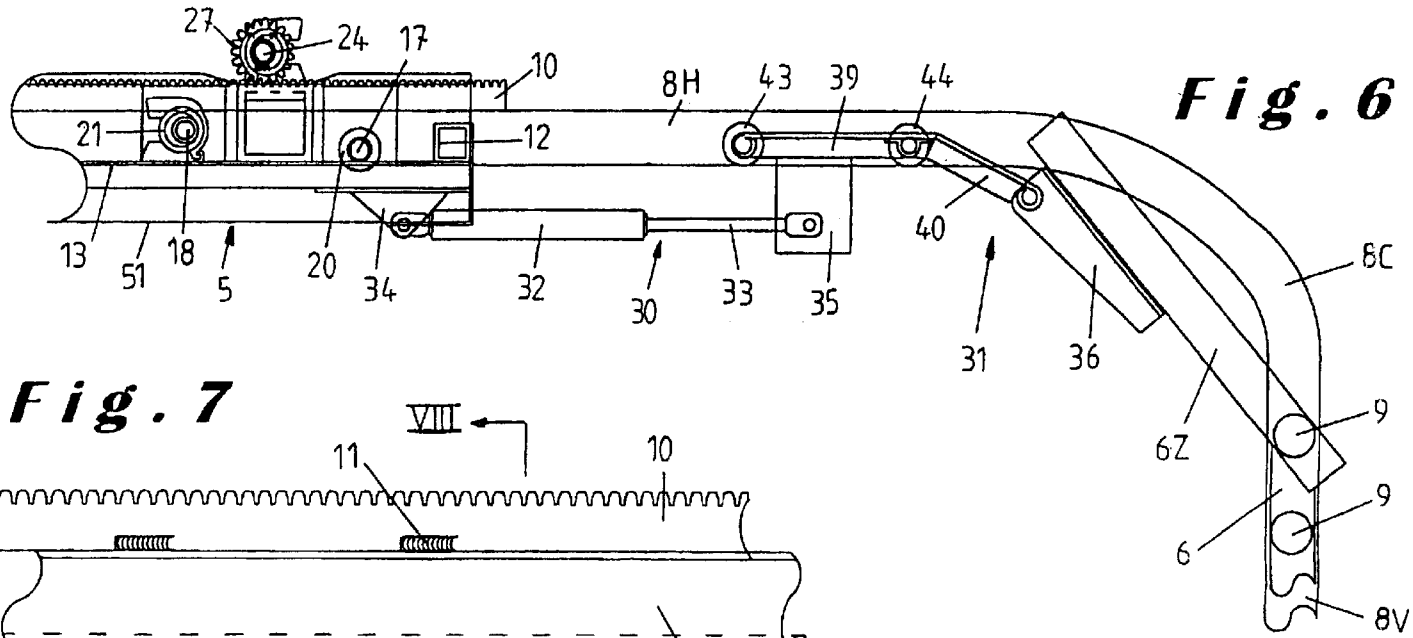
Figure 7:
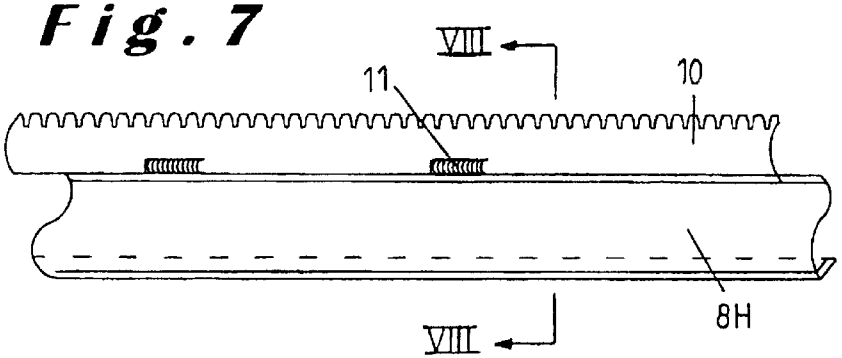
Figure 11:
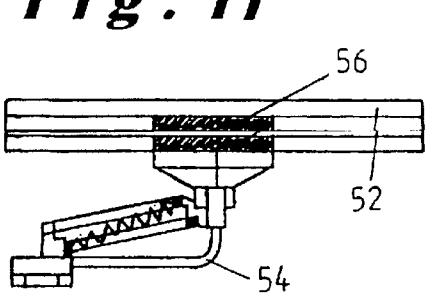
Figure 12:
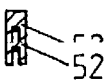
Figure 8:
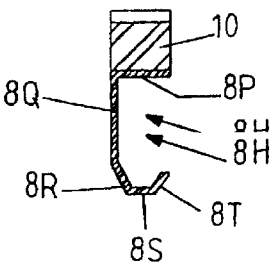
Figure 9:
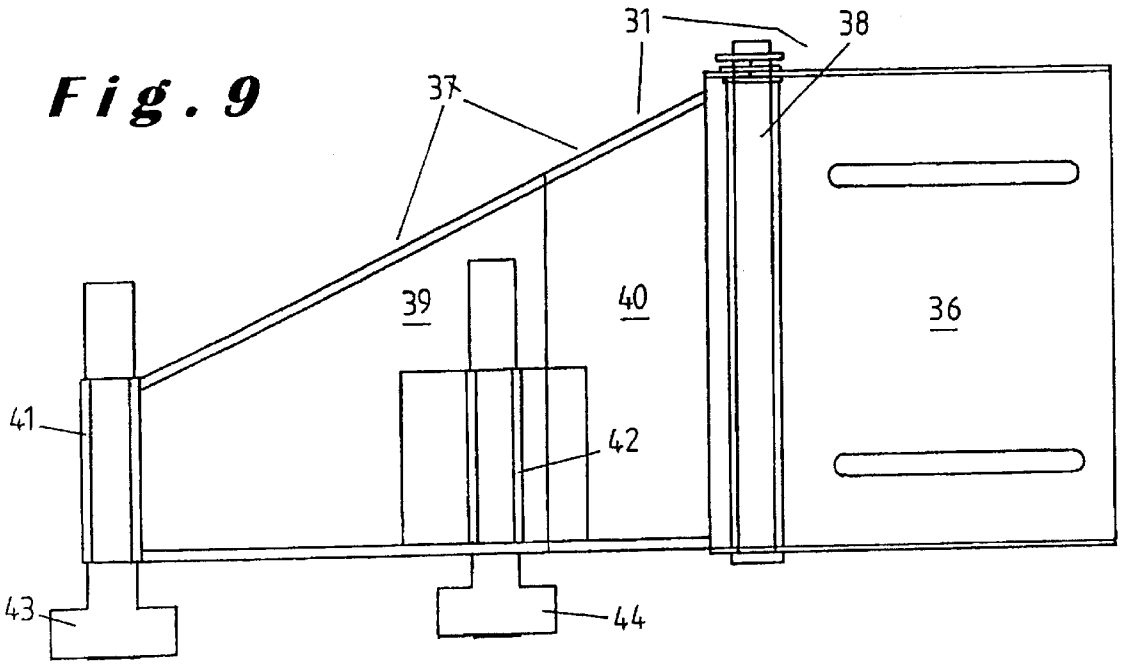
Figure 10:
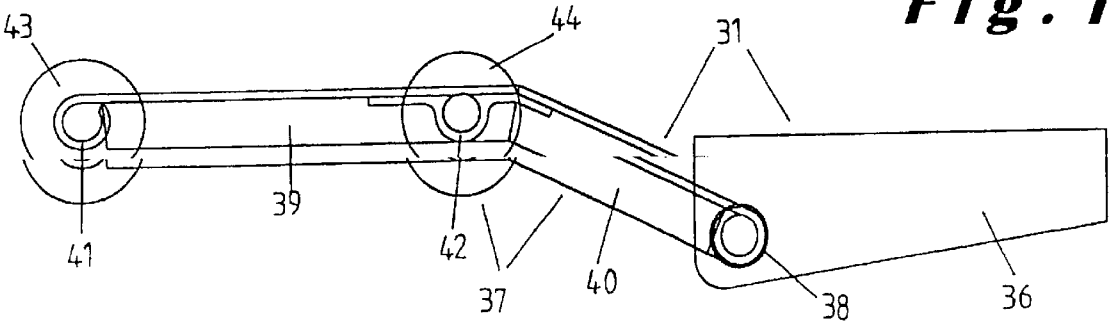
Figure 14:
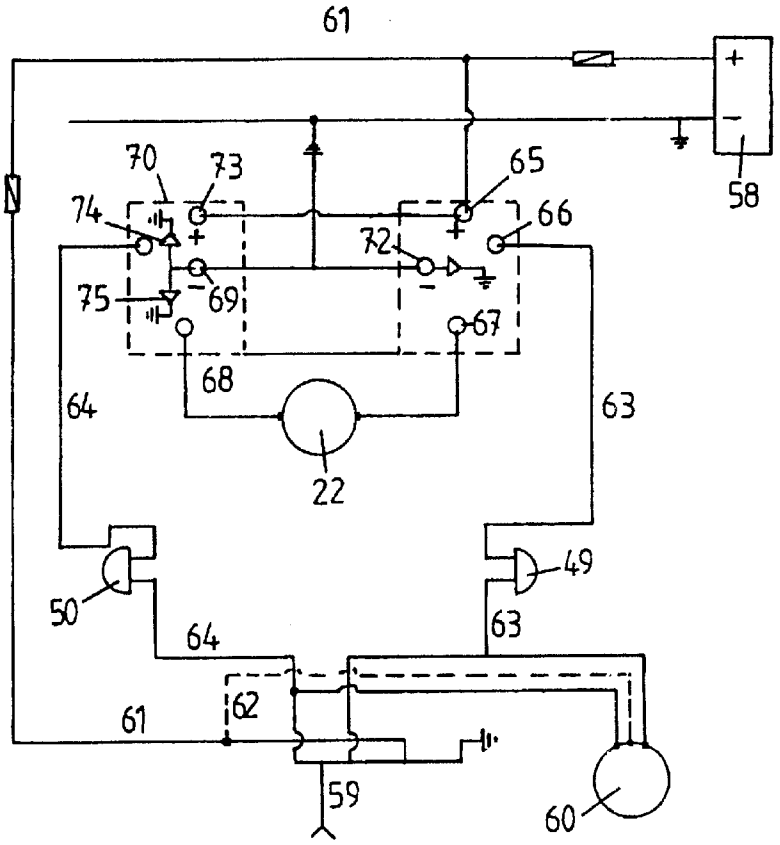
Figure 13:
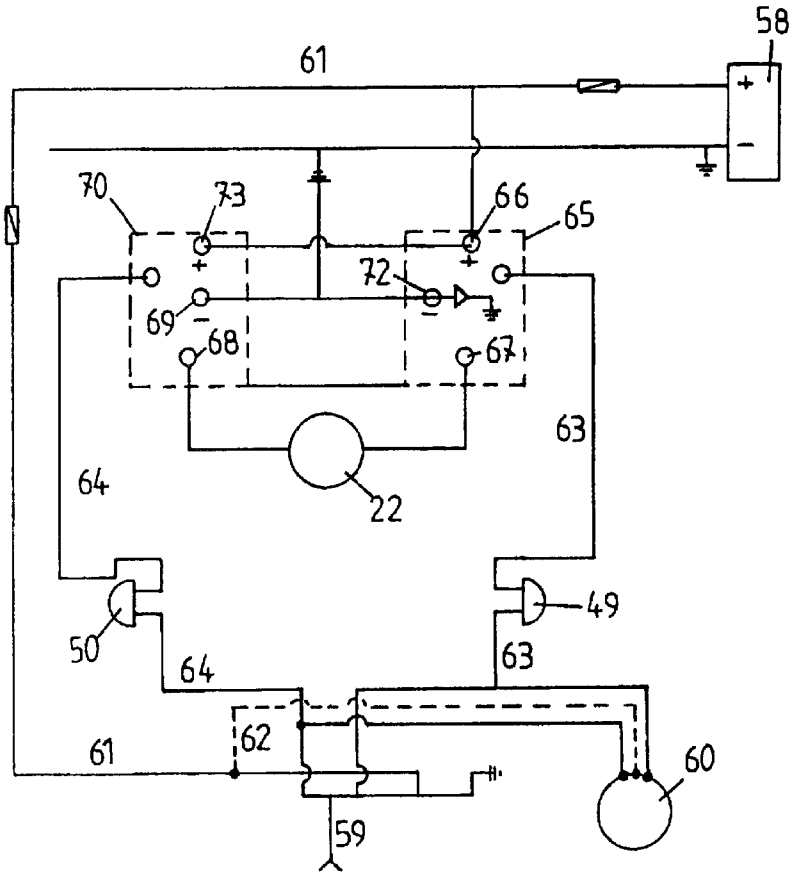
Figure 15:
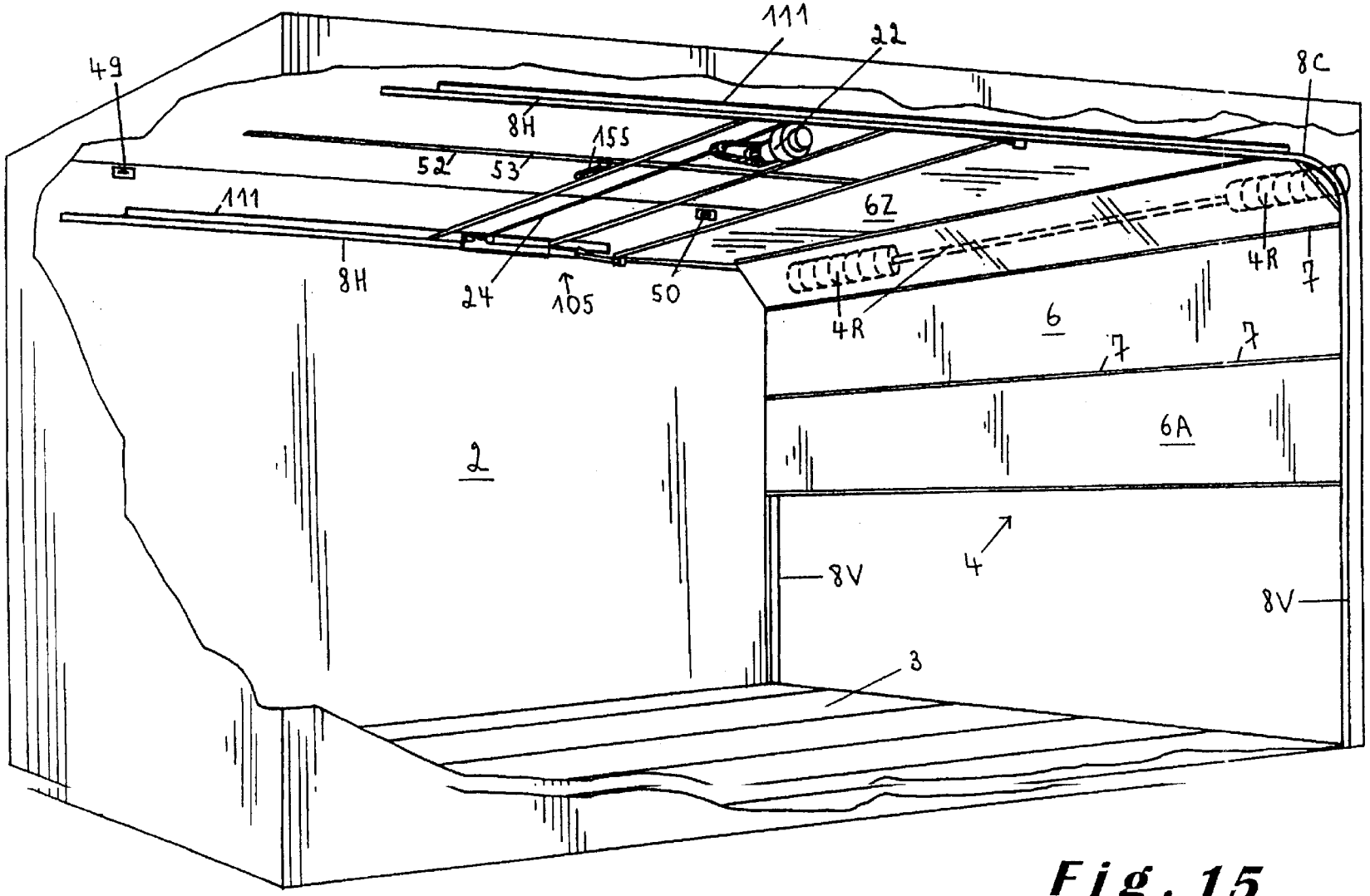
FIGS. 15 to 24 illustrate the second of these embodiments.
Figures 16, 17:
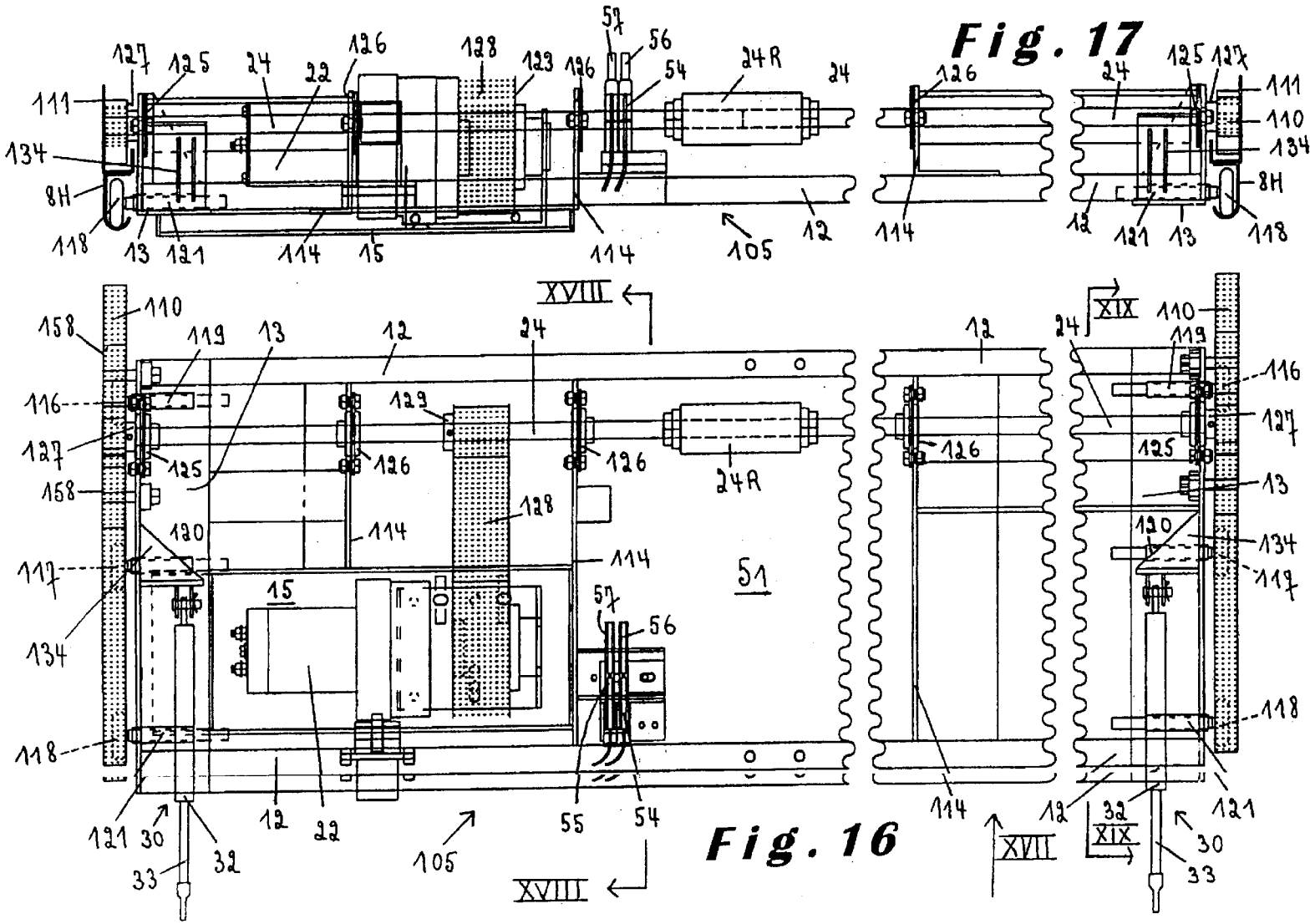
Figure 18:
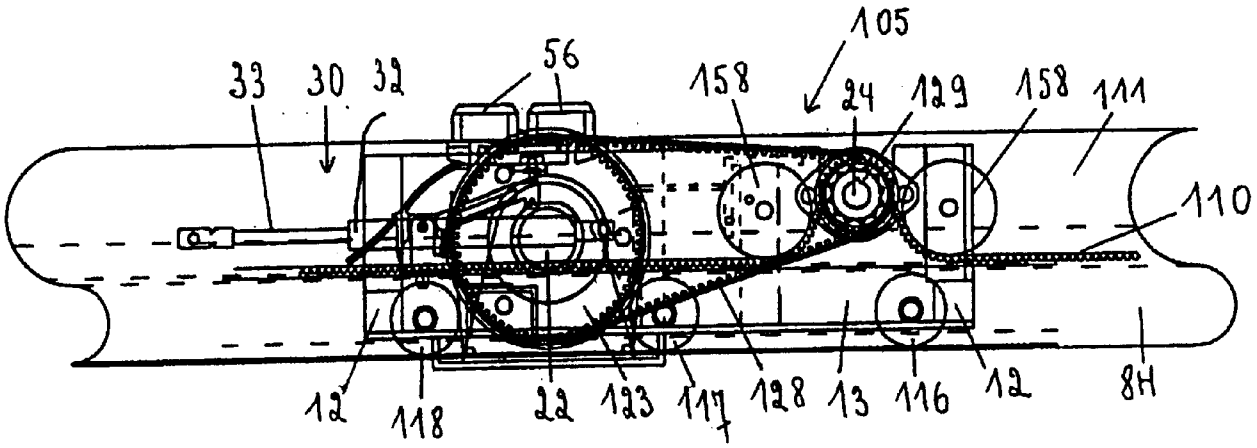
Figure 19:
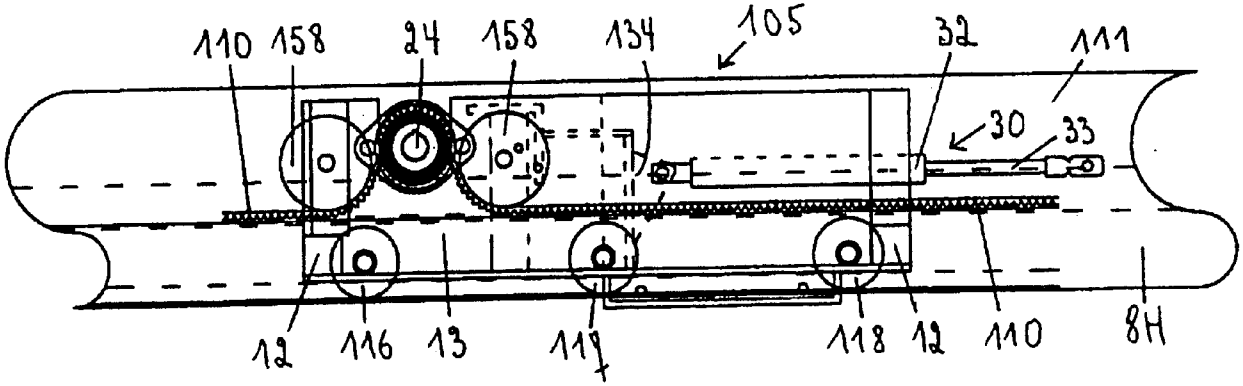
Figures 20, 21, 22, 23, 24:
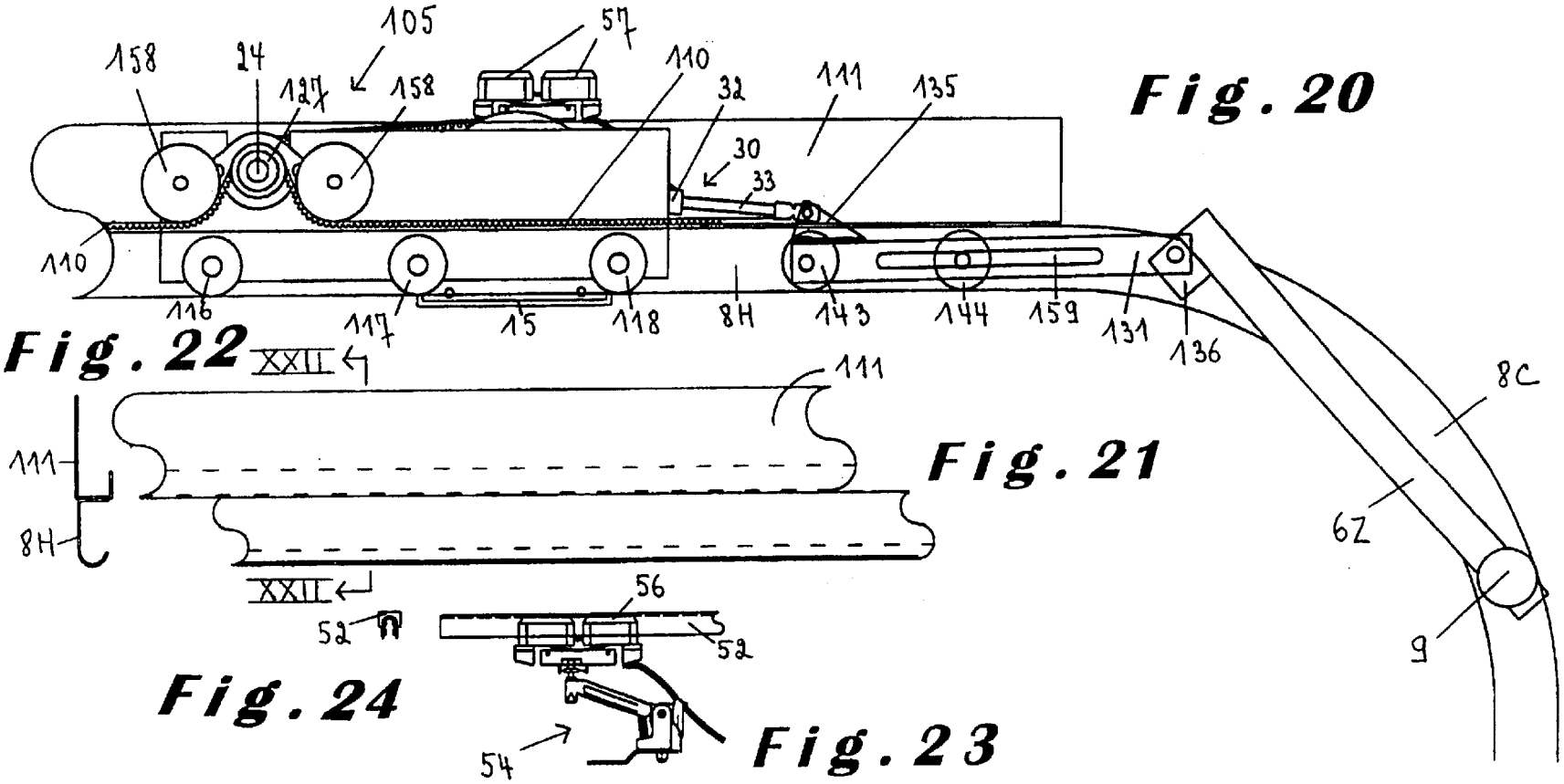

FIGS. 13 and 14 concern either of these two embodiments equally well;

FIG. 1, which concerns the first embodiment, is a schematic view, in perspective, with parts torn away, showing the assembly formed from a shutter and its drive device, mounted in the load body of a truck;

FIG. 2 is a plan view, with a break, of the shutter drive device, the left side of this figure being situated on the right side of the truck;

FIG. 3 is an elevational view, with a break, of the shutter drive device, along the arrow III in FIG. 2;

FIG. 4 is an elevational view of the shutter drive device, along the arrow IV in FIG. 2;

FIG. 5 is an elevational view of the shutter drive device, along the arrow V in FIG. 2;

FIG. 6 is a view similar to FIG. 5, showing the connection elements between the shutter and the drive device;

FIG. 7 shows, in a side view and on a larger scale, the assembly formed by a guide rail and a rack;

FIG. 8 is a section along the line VIII—VIII in FIG. 7;

FIG. 9 is a plan view, on a larger scale, of a connection piece between the shutter and the shutter drive device;

FIG. 10 is a side view of this same connection piece;

FIG. 11 is a detail view showing an electrical contact rail and a contact brush mounted on a power collector, in contact with this rail;

FIG. 12 is a cross-section of the contact rail;

FIG. 13 shows the electrical diagram of a shutter drive device;

FIG. 14 shows the electrical diagram of a shutter drive device, according to a variant implementation;

FIG. 15, which concerns the second embodiment, is a schematic view, with parts torn away, showing the assembly formed from a shutter and its drive device, mounted in the load body of a truck;

FIG. 16 is a plan view, with breaks, of the shutter drive device, the left side of this figure being situated on the left side of the truck;

FIG. 17 is an elevational view, with breaks, of the shutter drive device, along the arrow XVII in FIG. 16;

FIG. 18 is a section of the shutter drive device, along the line XVIII—XVIII in FIG. 16;

FIG. 19 is a section of the shutter drive device, along the line XIX—XIX in FIG. 16;

FIG. 20 is a view similar to FIG. 19, showing the connection elements between the shutter and the drive device;

FIG. 21 shows, in a side view, the assembly formed by a guide rail and a notched belt guard channel;

FIG. 22 is a section along the line XXII—XXII in FIG. 21;

FIG. 23 is a detail view showing an electrical contact rail and a contact brush mounted on a power collector, in contact with this rail, and FIG. 24 is a cross-section of the contact rail.

In the figures, identical or similar elements are designated by the same reference numbers.

FIG. 1 shows the assembly formed from a door shutter and its drive device, mounted in the load body of a truck, of which there can be seen the ceiling 1, a side wall 2 and the floor 3. The rear of this load body can be closed by a shutter 4 that can be driven to its position of opening or its position of closure by an electrical drive device comprising a carriage 5.

This shutter 4 which, in FIG. 1, is shown in an intermediate position between the open position and the closed position, is formed from a series of rectangular panels 6 connected to one another by means of articulations 7. The shutter 4 comprises a lower panel 6A and an upper panel 6Z.

The shutter 4 is provided with a balancing spring device 4R well known per se (depicted schematically) that pulls it towards its open position and thus approximately counterbalances the weight of the shutter 4 that pulls it towards its closed position.

The shutter 4 is guided in its movements between its open position and its closed position by means of two guide rails 8 in which there run guide rollers 9 (see FIG. 6) carried by the lateral edges of the panels 6.

Each of these two guide rails 8 comprises a first rectilinear part 8V, vertical in substance, mounted in a fixed manner along one side of the door opening, in the plane that the shutter 4 is to occupy in its closed position. This first rectilinear part 8V is connected, by means of a curved part 8C, to a second rectilinear part 8H, horizontal in substance, mounted in a fixed manner in the plane that the shutter 4 is to occupy in its open position.

These guide rails 8 have a section that is U-shaped in substance, the opening of the U of each rail 8 being directed towards the other rail 8. As can be seen in FIG. 8 which shows a section of the rail 8, one of the branches of the U consists of a flat piece 8P disposed perpendicular to the piece 8Q which forms the base of the U, while the other branch of the U is formed from three successive pieces 8R, 8S and 8T which together form a groove capable of laterally guiding the guide rollers 9 engaged in the rail 8.

A rack 10 is fixed above the horizontal rectilinear part 8H of each of the two guide rails 8. The rack 10 and the guide rail 8 are immovably attached to one another by small weld beads 11, as shown in FIG. 7.

In the previous section and in the remainder of the description, the terms "towards the front" and "front" must be understood in reference to the front of the truck. Similarly, "towards the rear" means "towards the rear of the truck".

As can be seen in FIGS. 2 to 5, the carriage 5, which constitutes an important element of the drive device for the shutter 4, comprises a rigid frame consisting principally of a rectangular structure formed from two square-sectioned steel tubes 12 (forming the large sides of the rectangle) and two steel sections 13 (forming the small sides of the rectangle). The steel tubes 12 and the steel sections 13 are immovably attached to one another by welding.

The frame of the carriage 5 also comprises a flat steel bar 14 disposed parallel to the steel sections 13 and fixed by welding against the lower face of the steel tubes 12.

A rectangular support plate 15 is fixed by welding on to the flat steel bar 14 and on to the steel section 13 closest to this flat steel bar 14, parallel to the steel tubes 12.

The carriage 5 is carried and guided by the rectilinear part 8H of the guide rails 8, in which there are engaged running rollers 16, 17, 18 mounted along the small sides of the frame of the carriage 5. On each of the two steel sections 13 (forming the small sides of the frame) there are fixed two bearings 19, 20 in which the shafts of the running rollers 16 and 17 turn and also a bearing 21, adjustable in height, in which the shaft of the running roller 18 turns. The rollers 16 and 17 run on the piece 8S of the lower branch of the rail 8H. The roller 18 runs against the upper branch 8P of the rail 8H.

On the support plate 15 carried by the frame of the carriage 5 there is fixed, by bolting, a reversible DC (12 V or 24 V) electric motor 22, with motor brake. The shaft of the motor 22, which is disposed parallel to the large side of the frame of the carriage 5, rotationally drives a sprocket wheel 23. A disengaging mechanism (not depicted), capable of being activated manually, disengages the sprocket wheel 23 with respect to the shaft of the motor 22.

A drive shaft 24, disposed parallel to the shaft of the motor 22, can turn in bearings 25, 26, adjustable in height, fixed on the steel sections 13 and the flat steel bar 14. A drive pinion 27 is fixed to each of the two ends of the drive shaft 24, meshing respectively with the two racks 10.

A chain 28 provides the transmission between the sprocket wheel 23, driven rotationally by the shaft of the motor 22, and a sprocket wheel 29 fixed on the drive shaft 24.

The carriage 5 is connected to the panel 6Z of the shutter 4, by means of two gas piston buffers 30. To that end, a connection piece 31 is fixed to the shutter panel 6Z, close to each lateral edge of this panel 6Z. The end of the cylinder 32 and the end of the piston rod 33 of each buffer 30 are fixed respectively to a trunnion fixing piece 34 fixed under the rear end of a steel section 13 of the frame of the carriage 5, and to a trunnion fixing piece 35 fixed to the corresponding connection piece 31.

The connection piece 31 is shown in more detail, and on a larger scale, in FIGS. 9 and 10. The connection piece 31 consists in fact of two elements articulated with one another. The first of these elements is a base plate 36, rectangular in substance, which is fixed by bolting (not depicted) against the face of the panel 6Z that is turned towards the inside of the body of the truck. An element 37 is connected to this base plate 36 by an articulation 38. The element 37 is formed from two pieces 39 and 40 forming an obtuse angle between them. The piece 39 carries two bearings 41 and 42 in which there are mounted the shafts of two running rollers 43 and 44 that are engaged in the guide rail 8H.

It should be noted that the connection piece 31 shown in FIGS. 9 and 10 is the one fixed to the left side of the panel 6Z (that is to say, on the left side of the truck). The connection piece 31 fixed to the right side of the panel 6Z is the spectral image of the one fixed to the left side.

Along the large sides of the frame of the carriage 5, two small plates 45 and 46 are welded vertically against the steel tubes 12 of this frame. In these plates 45 and 46 there are mounted, respectively, adjustment screws 47 and 48, the head of which is designed to activate, respectively, front end-of-travel switches and rear end-of-travel switches (not depicted).

It should be noted that the end-of-travel switches can be switches activated (that is to say, opened) by a mechanical contact with a mechanism carried by the carriage 5 (the screws 47 and 48), but they can also be the switches 49 and 50 of proximity detector type (see FIG. 1) that are activated (that is to say, opened) when an element carried by the carriage 5 comes close to them without, however, touching them.

The carriage 5 is masked and protected by a rectangular aluminum plate 51 fixed under this carriage 5, the large sides of this rectangular plate 51 being folded at right angles upward and fixed by screwing against the steel tubes 12 of the frame of the carriage 5.

As can be seen in FIG. 1, the rails 8H extend towards the front beyond the front end of the racks 10. This particular arrangement facilitates not only the installation of the carriage 5, during mounting of the device in the truck, but it also provides additional security. This is because, if, owing to a failure (highly improbable), the front end-of-travel switch 49 did not operate correctly during opening of the shutter 4, the carriage would continue its movement towards the front beyond what should normally be its extreme position towards the front. This undesired movement towards the front would, however, continue only over a small distance, up to the moment when the drive pinions 27 go past the front end of the racks 10. During this undesired movement towards the front, the carriage would remain carried and guided by the rails 8H. Stops (not depicted) can be fixed so as to be removable on the front ends of the rails 8H.

The electric motor 22 is connected to the electrical supply of the truck, by means of a system of sliding contacts. To that end, two contact rails 52, 53, with an inverted U-shaped section (see FIGS. 11 and 12) are fixed under the roof of the truck, parallel to the racks 10 (see FIG. 1). Articulated power collectors 54, 55, mounted on the carriage 5, carry contact brushes 56, 57 connected to the power supply cables of the motor 22. By virtue of a system of springs, the power collectors 54, 55 maintain electrical contact between the brushes 56, 57 and the contact rails 52 and 53.

The electrical diagram of a device according to the invention is shown in FIG. 13. A 12 V battery 58 (the truck battery) powers the electric motor 22 which is a reversible motor with motor brake. As depicted in the diagram, the device is equipped with two control stations but, according to variant implementations, it might be equipped with only one or other of these two control stations.

The first station consists of a remote control having a transmitter (not depicted), such as an FM radio transmitter, and a receiver 59.

The second station 60, which can be permanent or removable, is connected, or is capable of being connected, directly on to the electrical circuit by the lines 61 and 62 on the one hand, and by the lines 63 or 64 on the other hand.

Advantageously, the control station or stations are of the "dead man" type.

In order to bring the shutter 4 to its open position, the corresponding contactor button of one or other of the control stations is pressed. As long as this contactor button remains pressed, the receiver 59 or the control station 60 sends, via the line 63, a signal to the relay 65, so as to establish therein an electrical contact between the contact points 66 and 67 and establish an electrical contact between the contact points 68 and 69 of the relay 70. The power supply circuit of the motor 22 being thus closed, the motor 22 turns in the direction which corresponds to movement of the carriage 5 towards the front, and thus activates the opening of the shutter 4.

As soon as the contactor button corresponding to opening of the shutter 4 is released, the signal to the relay 65 is removed, the consequence of which is to break the power supply circuit of the motor 22 and immobilize the shutter 4.

The front end-of-travel switch 49 is inserted in the line 63. When the carriage 5 reaches its extreme position towards the front (which corresponds to the complete opening of the shutter 4), this switch 49 breaks the line 63, the consequence of which is therefore stopping of the motor 22 and immobilization of the carriage 5 and of the shutter 4.

In order to bring the shutter 4 to its closed position, the corresponding contactor button of one or other of the control stations is pressed. As long as this contactor button remains pressed, the receiver 59 or the control station 60 sends, via the line 64, a signal to the relay 70, so as to establish therein an electrical contact between the contact points 68 and 73 and establish an electrical contact between the contact points 67 and 72 of the relay 65. The power supply circuit of the motor 22 thus being closed in the reverse direction, the motor 22 turns in the direction which corresponds to movement of the carriage 5 towards the rear and thus activates closing of the shutter 4.

As soon as the contactor button corresponding to closing of the shutter 4 is released, the signal to the relay 70 is removed, the consequence of which is to break the power supply circuit of the motor 22 and immobilize the shutter 4.

The rear end-of-travel switch 50 is inserted in the line 64. When the carriage 5 reaches its extreme position towards the rear, this switch 50 breaks the line 64, the consequence of which is therefore stopping of the motor 22 and immobilization of the carriage 5 and of the shutter 4.

FIG. 14 shows an electrical diagram similar to that of FIG. 13, but it concerns a device according to the invention in which the motor 22 is powered by a 24 V battery. This electrical diagram is distinguished from that shown in FIG. 13 by the presence of two additional diodes 74, 75 in the relay 70.

FIG. 15 is a figure similar to FIG. 1, but illustrates a second form of electrical drive device according to the invention, this device being mounted in the load body of a truck. FIG. 22 shows a section of the guide rail 8.

A notched belt 110 (see FIGS. 16 to 20) is mounted above the horizontal rectilinear part 8H of each of the two guide rails 8. Each of the two ends of each notched belt 110 is fixed to a fixing support (not depicted). At least one of these supports is provided with means capable of exerting and maintaining an appropriate tension on the notched belt.

Each notched belt is held in a belt guard channel 111, which consists of a metal section fixed (for example by welding) above the horizontal rectilinear part 8H of each of the two guide rails 8. The form of the assembly formed by the rail 8 and the guard channel 111 is shown in FIGS. 21 and 22.

The carriage 105, shown in FIGS. 16 to 19, comprises a rigid frame similar to the rigid frame of the carriage 5 shown in FIGS. 2 to 5 (see description above).

The carriage 105 is carried and guided by the rectilinear part 8H of the guide rails 8, in which there are engaged running rollers 116, 117, 118 mounted along the small sides of the frame of the carriage 105. On each of the two steel sections 13 (forming the small sides of the frame) there are fixed the bearings 119, 120 and 121 in which the shafts of the rollers 116, 117 and 118 respectively turn.

On the support plate 15 carried by the frame of the carriage 105 there is fixed a reversible DC electric motor 22, with motor brake. The shaft of the motor 22, which is disposed parallel to the large side of the frame of the carriage 105, rotationally drives a notched wheel 123. A disengaging mechanism (not depicted), capable of being activated manually, disengages the notched wheel 123 with respect to the shaft of the motor 22.

A drive shaft 24, disposed parallel to the shaft of the motor 22, can turn in roller bearings 125 fixed in the steel sections 13 and in roller bearings 126 fixed in steel sections 114 fixed to the frame, parallel to the sections 13.

The drive shaft 24 is in fact constituted by the assembly of two shaft elements joined end to end by means of a shaft assembly sleeve 24R.

A notched wheel 127 is fixed to each of the two ends of the drive shaft 24, meshing respectively with the two notched belts 110, the notched face of which is situated downward.

Two free deflecting wheels 158 situated respectively in front of and behind each notched wheel 127 keep the notched belt 110 meshed with almost half the circumference of this notched wheel 127.

A notched transmission belt 128 provides the transmission between the notched wheel 123, driven rotationally by the shaft of the motor 22, and a notched wheel 129 fixed on the drive shaft 24.

The carriage 105 is connected to the panel 6Z of the shutter 4 by means of two gas piston buffers 30 and two connection pieces 131. The end of the cylinder 32 and the end of the piston rod 33 of each buffer 30 are fixed respectively to a trunnion fixing piece 134 fixed to a steel section 13 of the frame of the carriage 105 and to a trunnion fixing piece 135 fixed to the corresponding connection piece 131, close to one of the ends thereof.

The other end of each connection piece 131 is connected, able to pivot, to a connection mechanism 136 fixed close to the upper end of the shutter panel 6Z.

Each connection piece 131 is guided in a guide rail 8 by means of running rollers 143 and 144. The roller 143 is situated close to the front end of the connection piece 131. The roller 144 is mounted further towards the rear of the piece 131. An oblong opening fixed in the connection piece makes it possible to mount the roller 144 at the appropriate position which depends on the type of shutter 4 and on the radius of curvature of the part 8C' of the guide rail 8.

The carriage 105 is masked and protected by a rectangular aluminum plate 51 fixed under this carriage 105, the large sides of this rectangular plate 51 being folded at right angles upward and fixed by screwing against the tubes 12 of the frame of the carriage 105.

The shutter electrical drive devices according to the invention offer many advantages. Their operation is particularly reliable, quick and silent.

The elastic connection elements (gas piston buffers 30) make it possible to maintain the reliable and sealed closure of the shutter 4. According to a particular embodiment, each gas piston buffer 30 exerts a force of 600 N on the upper element 6Z of the shutter 4, when the shutter 4 is in its closed position.

One essential advantage of the device according to the invention lies, furthermore, in the fact that it is particularly compact which, in particular for truck shutters, is very important since the load capacity of the truck is not reduced.

The second embodiment described (FIGS. 15 to 24) is, from this point of view, even more advantageous than the first embodiment (FIGS. 1 to 12). This is because, in this second embodiment, the rectangular aluminum plate 51 (which constitutes the lower part of the carriage 105) is situated only a few millimeters under the level occupied by the shutter 4 in its position of opening.

The device according to this second embodiment also offers the advantage of operating with very little noise.

What is claimed is:

1. A shutter for a truck having a set of articulated elements and being provided to be moved along a path between a closed and an open position, and vice versa, said set comprising a lower panel element (6A) provided to contact a floor of said truck when said shutter is in said closed position and an upper panel element (6Z) connected to a base plate (36), said shutter (4) further having i) two rails disposed along said path and provided for guiding guide rollers applied on lateral edges of said articulated elements, said rails having a first rectilinear part (8V) mounted in a first plane substantially occupied by said shutter in its closed position and a second rectilinear part (8H) mounted in a second plane substantially occupied by said shutter in its open position, said first and second rectilinear parts being connected to each other by a curved part (8C), and ii) a drive device comprising:

a) two drive tracks respectively mounted in parallel along said second rectilinear part;

b) a carriage disposed between said second rectilinear parts of said guide rails and provided for being moved between extreme positions corresponding to positions of complete closure and complete opening of said shutter, said carriage comprising:

a rigid frame carried and guided by said second rectilinear part (8H) of said guide rails (8) for a translational movement parallel to said second rectilinear part (8H);

a drive shaft (24) mounted able to rotate on said frame (5, 105) and equipped on each of its two ends with means provided to engage said drive tracks (10, 110);

a motor (22) provided with a motor shaft, mounted on the frame and connectable to an energy supply source, a transmission (23, 28, 29, 123, 128, 129) between the motor shaft and the drive shaft (24), the motor shaft and the drive shaft (24) being situated Higher than the level of said second rectilinear part (8H) of the guide rails (8);

c) a control station capable of controlling the running and stopping of the motor (22) and therefore of controlling the opening and closing of the shutter (4); and d) a connection mechanism (30, 31, 34, 35, 131, 134, 135) comprising said base plate (36) and a connection element (37) being provided for connecting said carriage (5, 105) and the shutter elements to each other, said base plate (36) is connected to said connection element (37) by an articulation (38), said connection element (37) being formed of two pieces (39 and 40) forming an obtuse angle between them, said connection element being further connected to an elastic element (30) extending substantially parallel to said second rectilinear part and connecting said rigid frame to said connection element, said elastic element being provided to, when the carriage (5, 105) is in its extreme position which corresponds to the position of complete closure of the shatter (4), exert a pressure strength on said connection element (37), in order to maintain the shutter element in said closed position.

2. Shutter as claimed in claim 1, wherein the two guide rails (8) have a section that is U-shaped in substance, the opening of the U of each rail (8) being directed towards the other rail (8).

3. Shutter as claimed in claim 2, wherein the frame (5) is guided in the second rectilinear part (8H) of each of the two guide rails (8), by at least three Egg rollers, two of these rollers (16, 17) being disposed so as to be able to run against a part (8S) of the inside of the rail (8) that corresponds in substance to one of the branches of the U of its section, the third of these rollers (18) being disposed so as to be able to run against apart (8P) of the inside of the rail that corresponds in substance to the other branch of the U of its section.

4. Shutter as claimed in claim 1, wherein the electrical supply of the motor 22) is achieved by means of a system of sliding contacts comprising electrical contact rails (52, 53 fixed in place parallel to the drive tracks (10, 110), and contact brushes (56, 57) carried by the carriage (5, 105).

5. Shutter as claimed in claim 1, wherein the electric motor (22) is provided with a motor brake.

6. Shutter as claimed in claim 1, wherein transmission between the motor (22) and the drive shaft (24) is a notched belt transmission (128), the motor shaft and the drive shaft (24) each being equipped with a notched wheel (123, 129).

7. Shutter as claimed in claim 1, wherein the connection mechanisms (30, 31, 34, 35, 131, 134, 135) between the carriage (5, 105) and the shutter element (6Z) closest thereto connect the carriage (5, 105) to at least two parts of this shutter element (6Z) which are laterally spaced apart from one another, with respect to the direction of translational movement of this shutter element (6Z).

8. Shutter as claimed claim 1, wherein the connection mechanisms (30, 31, 34, 35, 131, 134, 135) between the carriage (5, 105) and the shutter element 46Z) closest thereto comprise a gas piston buffer (30).

9. Shutter as claimed claim 1, wherein it has means (49, 50) capable of limiting the translational movement of the carriage (5, 105) between extreme positions that co respond to the positions of complete closure and complete opening of the shutter (4).

10. Shutter as claimed in claim 9, wherein said means capable of limiting the translational movement of the carriage consist of end-of-travel switches (45, 50).

11. Shutter as claimed in claim 1, wherein said drive tracks (10) consist of racks (10), a pinion (27) being fixed to each of the two ends of the drive shaft (24), these two pinions (27) meshing respectively with the two racks (10).

12. Shutter as claimed in claim 11, wherein the second rectilinear part (8H) of each of the two guide rails (8) extends, in the direction opposite to the curved part (8C) of this rail (8), beyond the end of the rack (10) mounted along this rail (8H).

13. Shutter as claimed in claim 11, wherein the two racks (10) are respectively mounted above the second rectilinear part (8H) of the two guide rails (8).

14. Stutter as claimed in claim 13, wherein the teeth of the two racks (10) are situated at the opposite side to the guide rails (8H) above which they are respectively mounted.

15. Shutter as claimed in claim 13, wherein the two racks (10) are respectively immovably attached to the guide rails (8H) above which they are mounted.

16. Shutter as claimed in claim 1, wherein said drive tracks (110) consist of notched belts (110), a notched wheel (129) being fixed to each of the two ends of the drive shaft (24), these two notched wheels (129) meshing respectively with the two notched belts (110).

17. Shutter as claimed in claim 16, wherein the two notched belts (110) are respectively mounted above the second rectilinear part (8H) of the two guide rails (8).

18. Shutter as claimed in claim 16, wherein the notched side of the notched belts (110) is turned downward.

19. Shutter as claimed in claim 16, wherein two free deflecting wheels (58) keep each notched belt (110), constituting a drive track (110), meshed with the corresponding notched wheel (129).

20. Shutter as claimed in claim 16, wherein two free deflecting wheels (128) keep each notched belt (110) constituting a drive track (110) meshed with at least one third of the circumference of the corresponding notched wheel (129).

21. Device for electrically driving a shutter (4) for a truck having a set of articulated elements (6) and being provided to be moved along a path between a closed and an open position, and vice versa, said set comprising a lower panel element (6A) provided to contact a floor of said truck when said shutter is in said closed position and an upper panel element (6Z) connected to base plate (36), said shutter (4) further having i) two tails disposed along said path and provided for guiding guide rollers applied on lateral edges of said articulated elements, said rails having a first rectilinear part (8V) mounted in a first plane substantially occupied by said shutter in its closed position and a second rectilinear part (8H) mounted in a second plane substantially occupied by said shutter in its open position, said first and second rectilinear parts being connected to each other by a curved part (8C), and ii) a drive device comprising:

a) two drive tracks respectively mounted in parallel along said second rectilinear part;

b) a carriage disposed between said second rectilinear parts of said guide rails and provided for being moved between extreme positions corresponding to positions of complete closure and complete opening of said shutter, said carriage comprising:

a rigid frame carried and guided by said second rectilinear part (8H) of said guide rails (8) for a translational movement parallel to said second rectilinear part (8H);

a drive shaft (24) mounted able to rotate on said frame (5, 105) and equipped on each of its two ends with means provided to engage said drive tracks (10, 110);

a motor (22) provided with a motor shaft, mounted on the fame and connectable to an energy supply source;

a transmission (23, 28, 29, 123, 128, 129) between the motor shaft and the drive shaft (24), the motor shaft and the drive shaft (24) being situated higher than the level of said second rectilinear part (8H) of the guide rails (8);

c) a control station capable of controlling the running and stopping of the motor (22) and therefore of controlling the opening and closing of the shutter (4); and d) a connection mechanism (30, 31, 34, 35, 131, 134, 135) comprising said base plate (36) and a connection element (37) being provided for connecting said carriage (5, 105) and the shutter elements to each other, said base plate (36) is connected to said connection element (37) by an articulation (38), said connection element (37) being formed of two pieces (39 and 40) forming an obtuse angle between them, said connection element being further connected to an elastic element (30) extending substantially parallel to said second rectilinear part and connecting said rigid frame to said connection element, said elastic element being provided to, when the carriage (5, 105) is in its extreme position which corresponds to the position of complete closure of the shutter (4), exert a pressure strength on said connection element (37), in order to maintain the shutter element in said closed position.

* * * * *